US009894983B2

(12) United States Patent
Hernandez et al.

(10) Patent No.: US 9,894,983 B2
(45) Date of Patent: Feb. 20, 2018

(54) MEDIA CORD MANAGING ZIPPER SYSTEM

(71) Applicant: NIKE, Inc., Beaverton, OR (US)

(72) Inventors: Michael Hernandez, Portland, OR (US); Kristin Reiter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/248,840

(22) Filed: Aug. 26, 2016

(65) Prior Publication Data

US 2016/0360872 A1 Dec. 15, 2016

Related U.S. Application Data

(63) Continuation of application No. 13/828,493, filed on Mar. 14, 2013, now Pat. No. 9,480,310.

(51) Int. Cl.

| | |
|---|---|
| ***A44B 19/26*** | (2006.01) |
| ***A45F 5/02*** | (2006.01) |
| ***H04R 5/033*** | (2006.01) |

(52) U.S. Cl.

CPC ..... *A45F 5/02* (2013.01); *A44B 19/262* (2013.01); *H04R 5/0335* (2013.01); *A45F 2005/023* (2013.01); *Y10T 24/2561* (2015.01)

(58) Field of Classification Search

CPC ..... H04R 1/1033; H04R 1/1016

USPC ..... 381/374, 384; 24/3.11, 3.12, 349; 248/693, 689, 682, 61, 63, 60, 215, 248/222.12, 229.13, 229.14, 227.3, 230.5, 248/231.61, 316.6, 74.3, 229.16; 242/588, 129

See application file for complete search history.

(56) References Cited

U.S. PATENT DOCUMENTS

| | | | |
|---|---|---|---|
| 4,976,015 | A | 12/1990 | Ishii |
| 5,771,546 | A | 6/1998 | Minato |
| D526,931 | S | 8/2006 | Koenig et al. |
| 7,519,192 | B1 | 4/2009 | Laycock et al. |
| 7,673,348 | B2 | 3/2010 | Williams |
| 7,817,444 | B2 | 10/2010 | Dennes |
| 8,107,653 | B2 | 1/2012 | Wolfe |
| 8,269,110 | B2 | 9/2012 | Scifo et al. |
| 2003/0074712 | A1 | 4/2003 | Liao |
| 2007/0124901 | A1 | 6/2007 | Cyr et al. |
| 2011/0162883 | A1 | 7/2011 | Groset et al. |
| 2011/0228965 | A1 | 9/2011 | Farrell et al. |

(Continued)

FOREIGN PATENT DOCUMENTS

| | | | |
|---|---|---|---|
| JP | S49106502 | U1 | 10/1974 |
| JP | H02068711 | U1 | 5/1990 |
| JP | H02118387 | U1 | 9/1990 |

(Continued)

OTHER PUBLICATIONS

European Search Report dated Oct. 7, 2016 in European Patent Application No. 14773303.4, 5 Pages.

*Primary Examiner* — Jack W Lavinder

(74) *Attorney, Agent, or Firm* — Shook, Hardy & Bacon, LLP

(57) ABSTRACT

Media cord managing zipper systems in accordance with the present invention may comprise a zipper slider and a pull tab. Prongs may extend from the pull tab on opposing sides of a longitudinal axis of the pull tab. The prongs may be shaped to hold portions of a media cord in a cavity of the pull tab. The media cord managing zipper system may be incorporated into articles of clothing, such as jackets and sweatshirts.

12 Claims, 15 Drawing Sheets

(56) References Cited

U.S. PATENT DOCUMENTS

2012/0045084 A1 2/2012 Groset et al.

FOREIGN PATENT DOCUMENTS

| | | | |
|---|---|---|---|
| WO | 2008051582 | A2 | 5/2008 |
| WO | 2011050411 | A1 | 5/2011 |
| WO | 2012070940 | A1 | 5/2012 |

MEDIA CORD MANAGING ZIPPER SYSTEM

CROSS-REFERENCE TO RELATED APPLICATIONS

This application entitled "MEDIA CORD MANAGING ZIPPER SYSTEM," claims priority to U.S. application Ser. No. 13/828,493, entitled "MEDIA CORD MANAGING ZIPPER SYSTEM," filed Mar. 14, 2013. The entirety of the aforementioned application is incorporated by reference herein.

FIELD

The present invention relates to zippers on articles of clothing that can be used to manage media cords.

SUMMARY

This summary is provided to introduce a selection of concepts in a simplified form that are further described below in the detailed description. This summary is not intended to identify key features or essential features of the claimed subject matter, nor is it intended to be used in isolation as an aid in determining the scope of the claimed subject matter.

The present invention relates to an efficient way of managing media cords. Zippers are prevalent in modern clothing, especially active clothing such as sweatshirts or jackets. Media players did not exist when zippers were first incorporated into clothing. Consequently, zippers have not been designed with media cords in mind. As a result, media cords cannot be easily incorporated into the physical structure of most zippers.

Using a zipper to manage media cords avoids incorporating additional components into an article of clothing. Additional components dedicated to media cord management can make clothing bulkier and heavier, both of which can interfere with the wearer's freedom of movement or sporting performance. A zipper comprises a zipper slider and a pull tab. The zipper slider operates to engage or disengage two parallel rows of protruding teeth. Inside the zipper slider is a Y-shaped channel that either meshes together or separates the opposing rows of teeth depending on the direction of the zipper slider's movement. A pull tab may be equipped with two prongs on either side of its longitudinal axis. One or more portions of a media cord may be threaded through a gap between one of the two prongs and the respective lateral side of the pull tab and be made to rest securely therein. The pull tab retains the cord in place while the wearer moves about in pursuit of various physical activities.

In another example of the invention, the zipper system may be made from one or more materials such as aluminum, brass, and plastic. Various parts of the system may be encased in compressible rubber in order to lessen wear on media cords retained by the zipper pull and to make the zipper more comfortable to the touch. Moreover, the prongs on the pull tab may be flexible, capable of being bent.

In yet another example of the invention, the prongs have two positions, namely open and closed, with respect to the lateral sides of the pull tab. The prongs may receive media cords in the open position and retain same in the closed position.

DRAWINGS

The drawings described herein are referred to using particular numbers in which.

Figure 5:
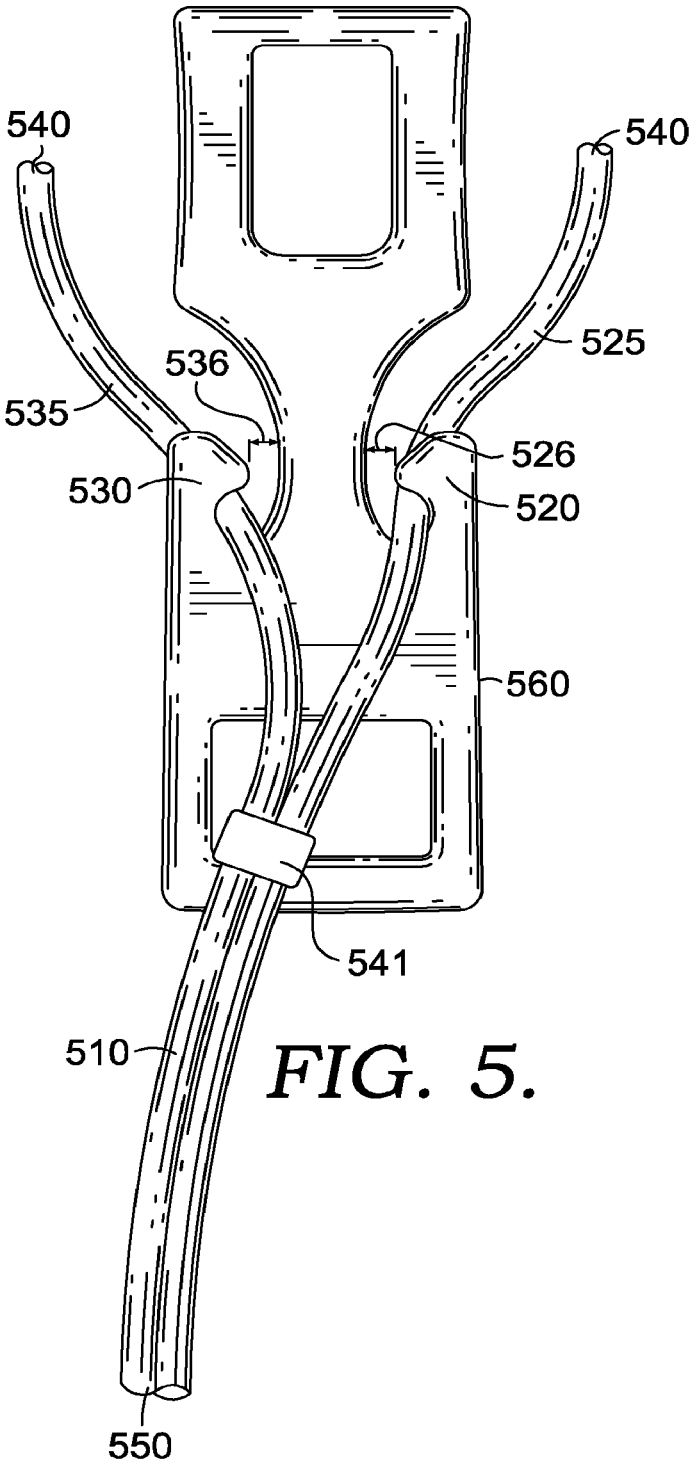
Figure 6A:
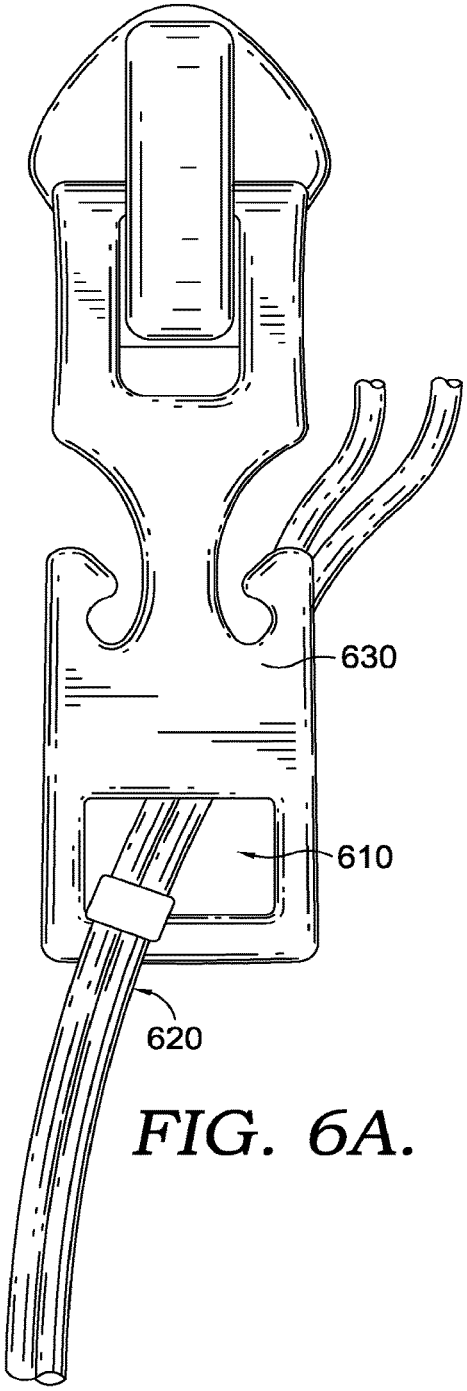
Figure 6B:
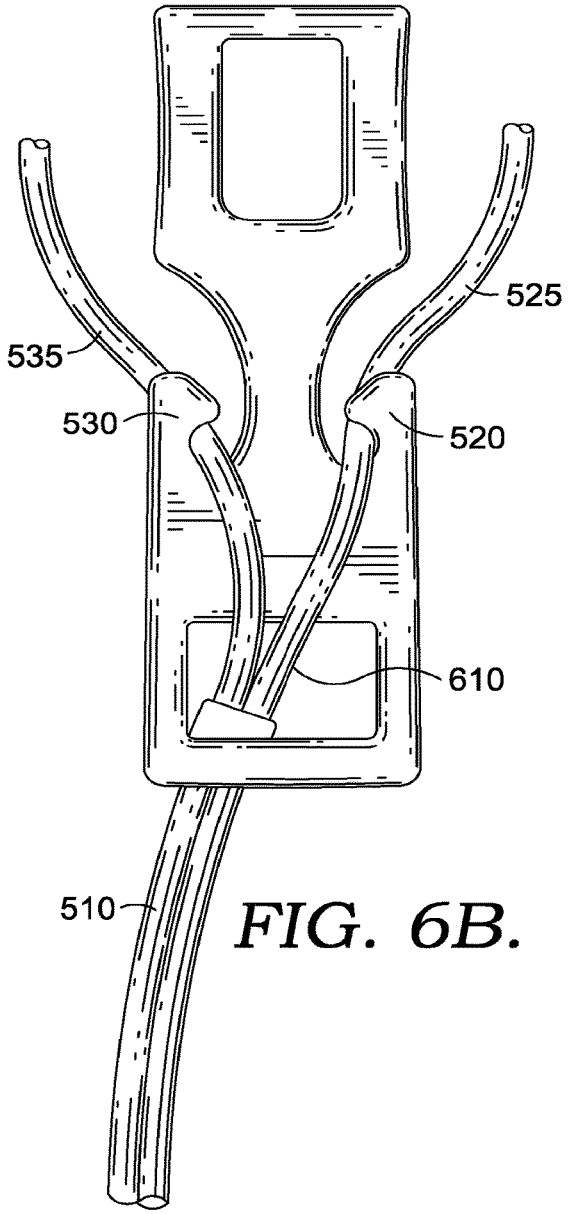
Figure 8A:
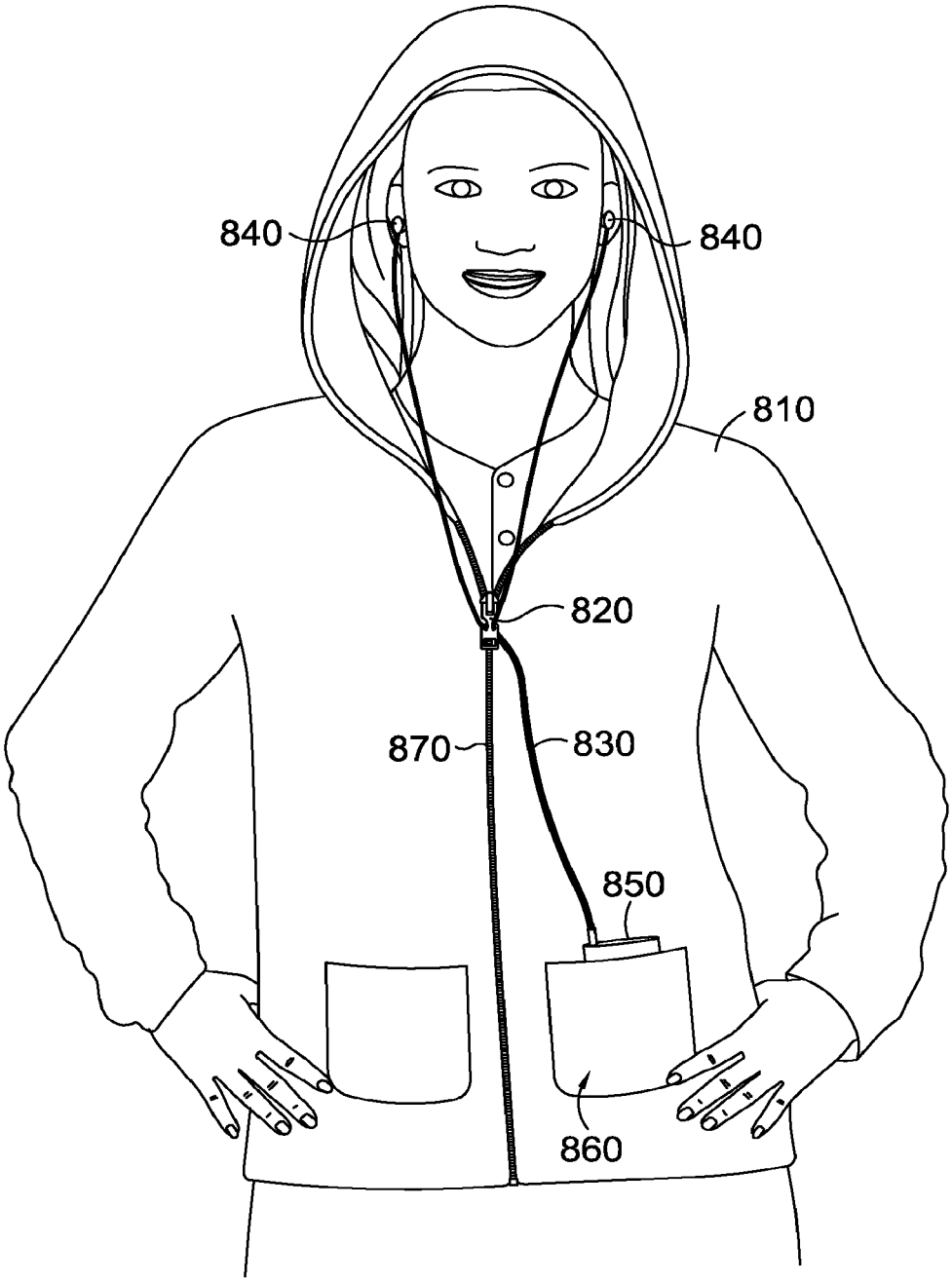
Figure 8B:
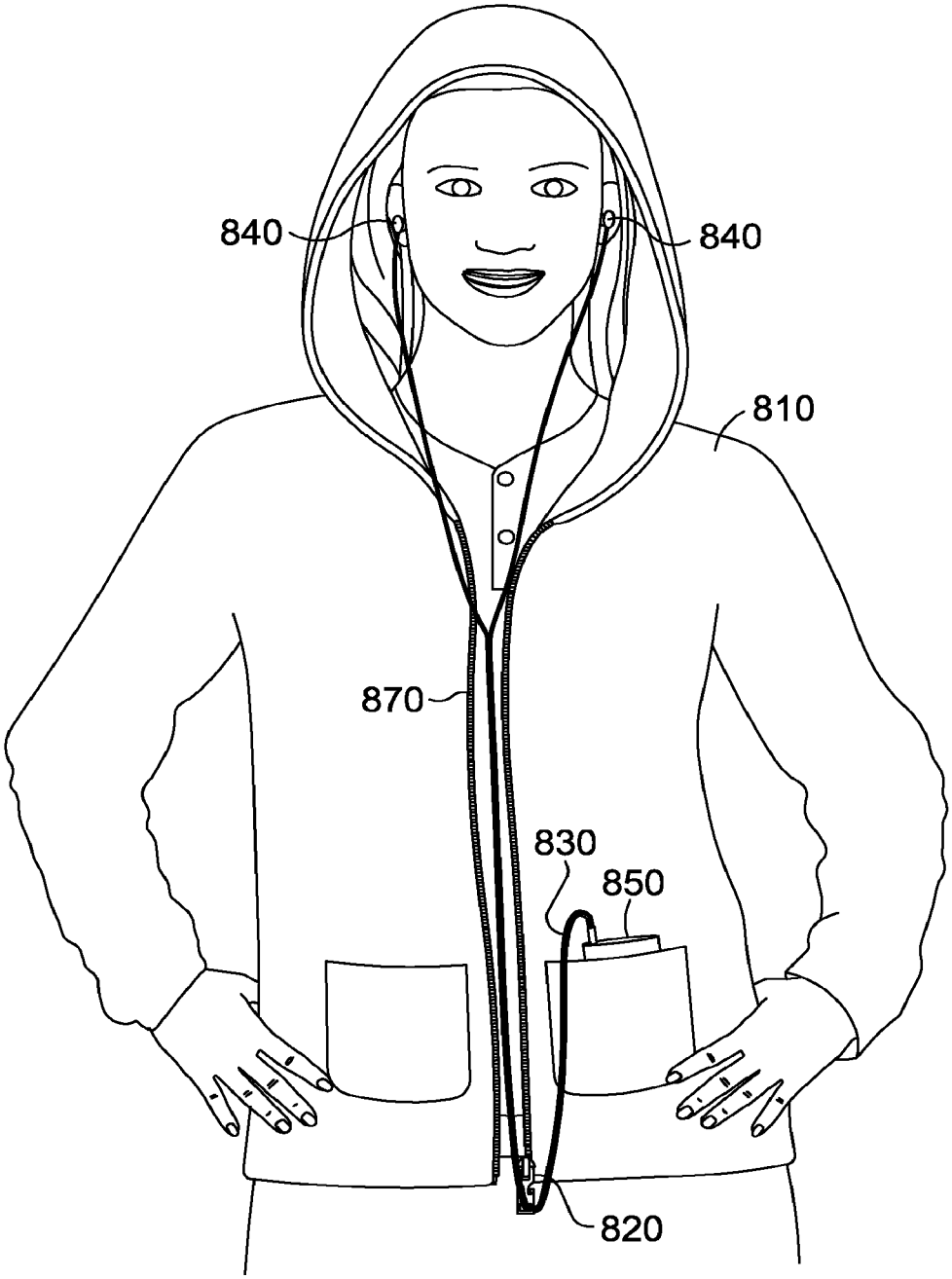

FIGS. 5, 6A, and 6B illustrate schematic diagrams of an example of a cord managing zipper system receiving portions of a media cord in accordance with the present invention;

FIGS. 7A-7E illustrate schematic diagrams of an example of a cord managing zipper system receiving portions of a media cord in accordance with the present invention;

FIGS. 8A and 8B illustrate schematic diagrams of an example of a cord managing zipper system being worn by a user in accordance with the present invention; and FIGS. 9-13 illustrate schematic diagrams of examples of a cord managing zipper system in accordance with the present invention.

DETAILED DESCRIPTION

Figure 1A:
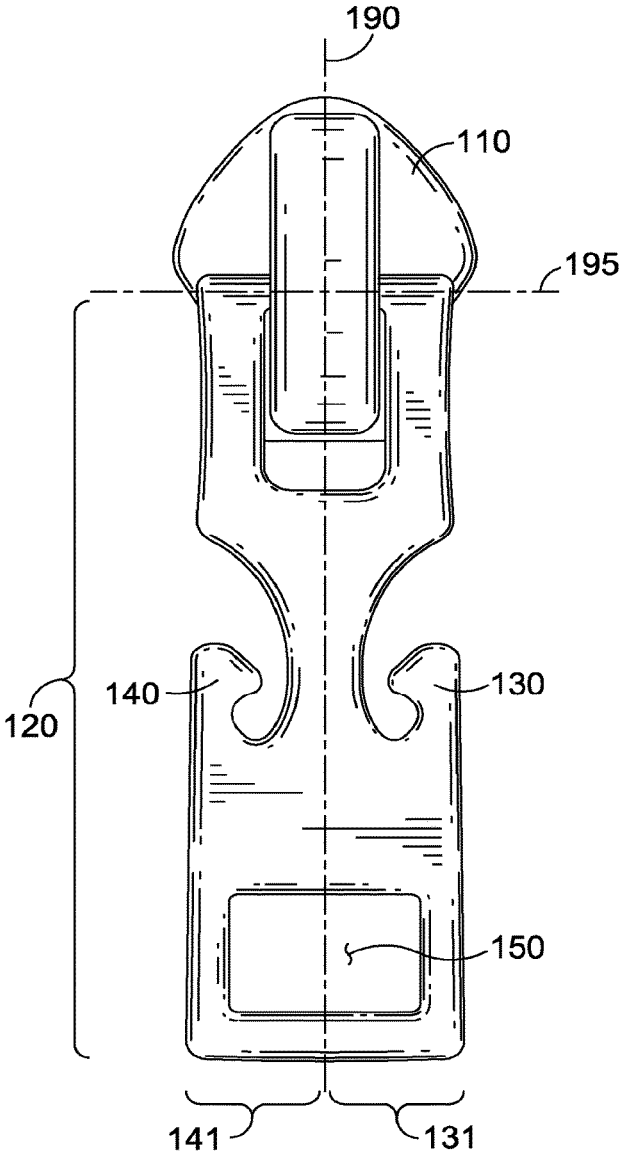
FIG. 1A illustrates a schematic diagram of an example of a cord managing zipper system in accordance with the present invention.
Figure 1B:
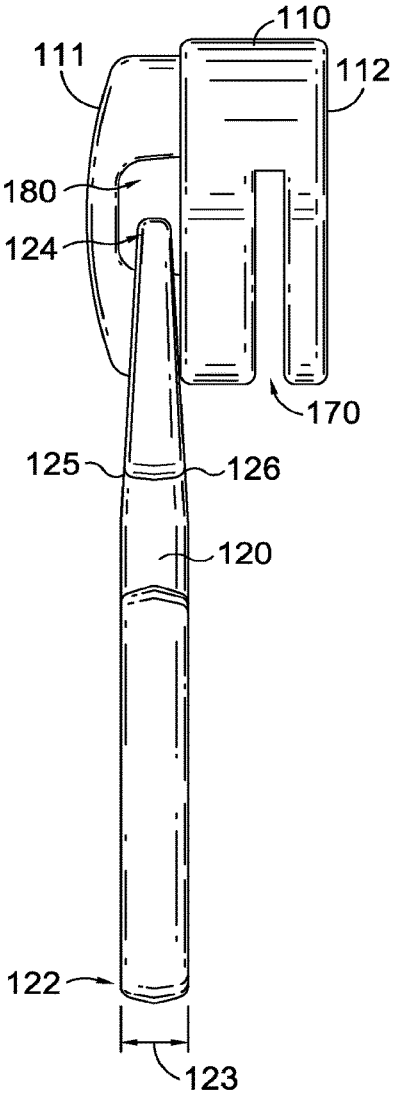
FIG. 1B illustrates a side view of the example of a cord managing zipper system shown in FIG. 1A.

Referring now to FIGS. 1A-1B, schematic diagrams showing front and side views of an example of a cord managing zipper system in accordance with the present invention. In FIG. 1A, the system comprises a zipper slider 110 and a pull tab 120. Pull tab 120 is shown with a left side 141 and a right side 131 with respect to longitudinal axis 190. Pull tab 120 comprises prongs 130 and 140 located on the right and left hand sides of longitudinal axis 190, respectively. The prongs extend from the lower portion of the pull tab 120 and curl inward. In another example, the prongs may extend from the top portion of the pull tab and curl downward. The prongs may be made from a material different from that of the rest of pull tab 120. For instance, pull tab 120 can be made out of metal with prongs 130 and 140 further coated in compressible rubber. The exemplary pull tab 120 shown in FIG. 1A also provides a cavity 150. Cavity 150 may also be circular, triangular, or any other shape, or may be omitted entirely. FIG. 1B shows the thickness of pull tab 120 from a lateral side. Pull tab 120 may taper in thickness, becoming gradually thicker from end 122 to end 124. The pull tab 120 may also have a consistent thickness 123 from end 122 to end 124.

With continued reference to FIG. 1B, a side view of the same system is presented wherein the zipper slider 110 and pull tab 120 are shown connected via cavities in both components. Pull tab has a front 125 and a back 126. Zipper slider 110 is shown with a front 111 and a back 112. In addition, the end 124 of pull tab 120 can hingedly move within cavity 180 about rotational axis 195 (shown in FIG. 1A).

Figure 2:
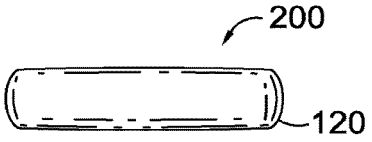
FIG. 2 illustrates a top-down view of the example of a cord managing zipper system shown in FIG. 1A.

A top-down view 200 of the pull tab 120 is shown in FIG. 2.

Figure 3:
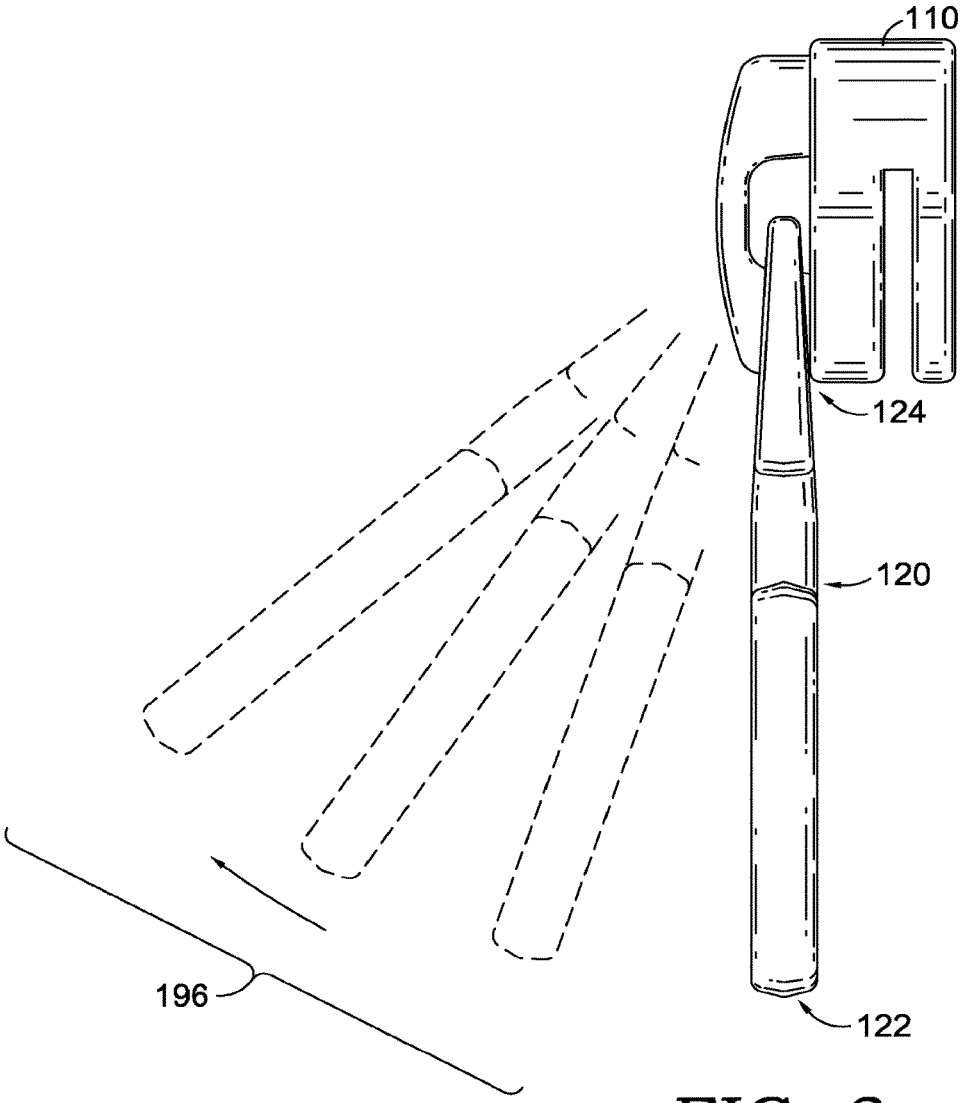
FIG. 3 illustrates a schematic diagram of an example of a pull tab rotating about a zipper slider in accordance with the present invention.

Turning to FIG. 3, a side view of the same system is presented wherein end 124 of pull tab 120 is rotating about zipper slider 110. The phantom dots 196 show possible positions for pull tab 120 as it rotates about rotational axis 195 (shown in FIG. 1A).

Figure 4:
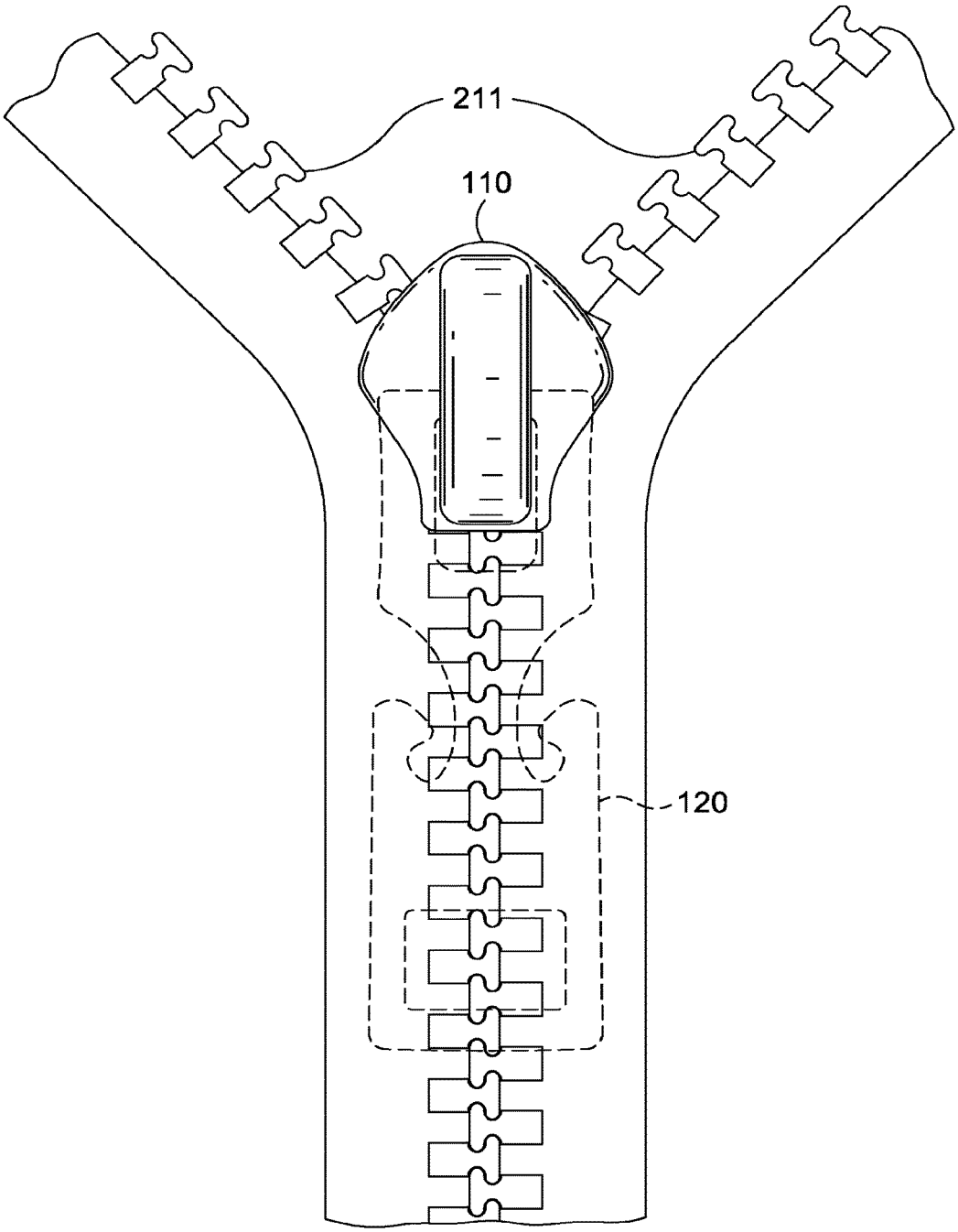
FIG. 4 illustrates a schematic diagram of an example of a cord managing zipper system engaging two parallel rows of zipper teeth in accordance with the present invention.

Turning to FIG. 4, the same system is shown in combination with two parallel rows of zipper teeth. Zipper slider 110 is configured to engage two parallel rows of zipper teeth 211 at cavity 170 (shown in FIG. 1B). Zipper slider 110 may engage other forms of parallel attachment structures to close a garment when engaged and open same when disengaged. The pull tab 120 is shown with dotted lines in order to enhance the depiction of zipper slider 110 and zipper teeth 211. The zipper slider 110 and pull tab 120 can be made from the same or different materials. Examples of materials suitable for use in constructing zipper slider 110, pull tab 120, and zipper teeth 211 are aluminum, brass, nickel, plastic, and rubber.

Turning now to FIGS. 5-6, schematic diagrams showing an example of a cord managing zipper system in accordance with the present invention are shown. In FIG. 5, portions 525 and 535 of a media cord are inserted beneath prongs 520 and 530, respectively. Portions 525 and 535 are two separate cords from ends 540 to convergence point 541. From convergence point 541 to end 550, portions 525 and 535 intertwine to form one entity 510. The media cord can be attached to earphones or headphones on end 540 and to a mobile device on end 550. Examples of mobile devices include phones, MP3 players, CD players, cassette players, and radios. Portions 525 and 535 may be encased in a flexible or compressible material. The distance of gaps 526 and 536 may be slightly smaller than the diameters of compressible portions 525 and 535, respectively, such that the gaps admit passage to the respective portions with a light push from the user's finger. Once inside the space enclosed by a prong and a lateral side of the pull tab, a portion cannot exit the gap without another light push from the user's finger. In another example, the distance of the gaps 526 and 536 can be slightly larger than the diameters of the cord portions 525 and 535, respectively. While inside the space enclosed by a prong and a lateral side of the pull tab, portions 525 and 535 can move vertically such that different parts of portions 525 and 535 come in contact with the inside surfaces of prongs 520 and 530, respectively. However, horizontal movement of portions 525 and 535 is restricted to the areas partially bounded by inside surfaces of prongs 520 and 530, respectively.

In FIG. 6A, a media cord 620 is inserted into pull tab 630 through cavity 610. The movement of media cord 620 is restricted to the area of cavity 610. Media cord 620 can enter cavity 610 through the back, as shown, or through the front.

In FIG. 6B, portions 525 and 535 of a media cord are inserted beneath prongs 520 and 530, respectively. At the same time, cord 510 is inserted through cavity 610.

Figure 7A:
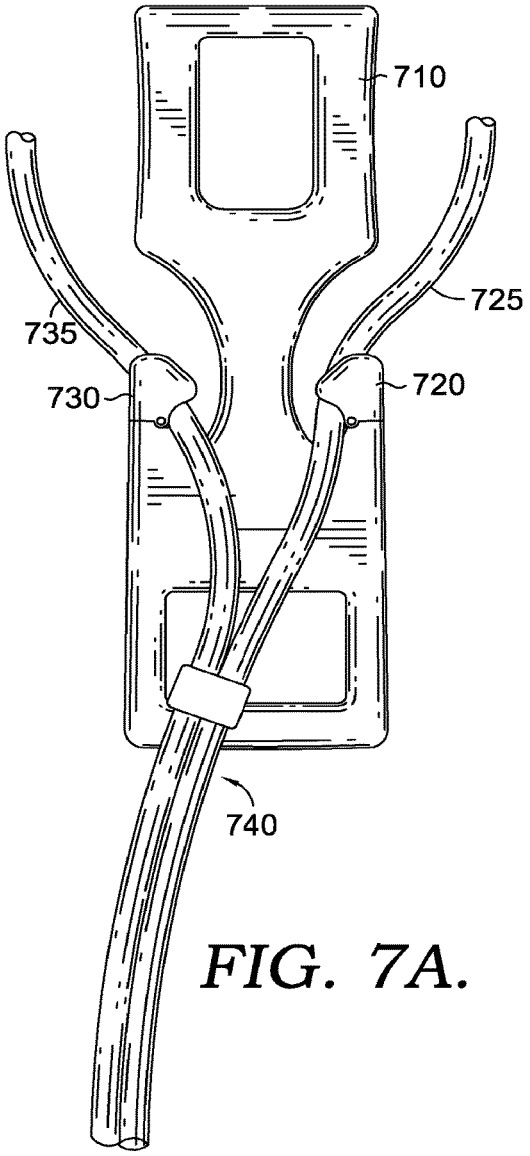
Figure 7B:
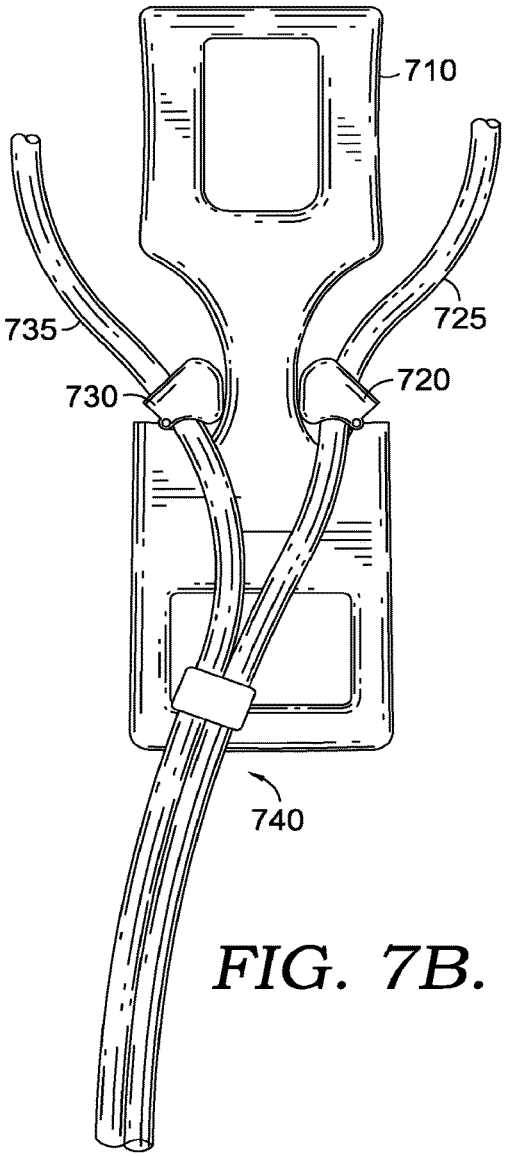
Figure 7C:
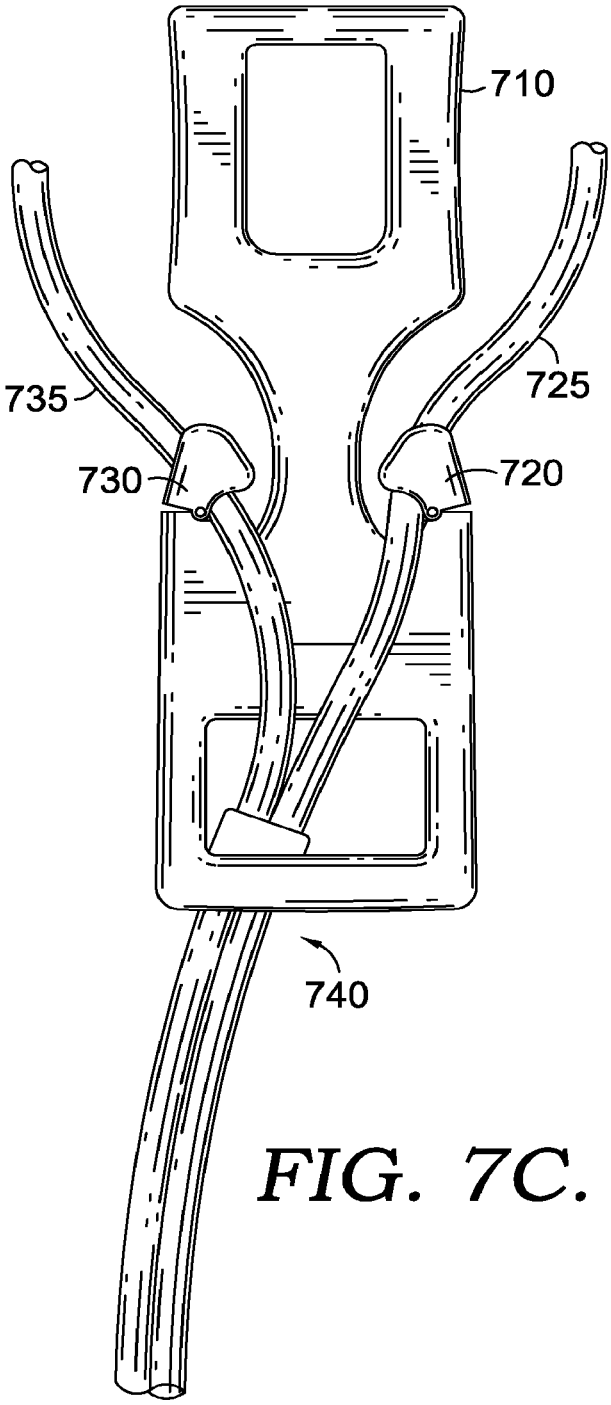

Now turning to FIGS. 7A-7E, schematic diagrams showing an example of a cord managing zipper system in accordance with the present invention are shown. Pull tab 710 provides prongs 720 and 730. Both prongs 720 and 730 have two resting positions: open and closed. FIG. 7A shows the prongs in the open position. In open position, there is a gap between a prong and its respective lateral side of pull tab 710. Portions 725 and 735 of media cord 740 can be admitted into the gap and rest within the enclosure created by the prongs and the lateral sides of pull tab 710. FIG. 7B shows the prongs 720 and 730 in the closed position. In the closed position, the prongs 720 and 730 may be pressed against their respective lateral sides of the pull tab 710 such that no gap remains. Alternatively, in the closed position, prongs 720 and 730 may leave a gap between them and their respective lateral sides of pull tab 710, as shown in FIG. 7C. The resulting closed enclosures of 7B-C retain portions 725 and 735 in place. In one example, prongs 720 and 730 are shaped such that portions 725 and 735 are rendered completely immobile once the prongs are in the closed position. In another example, prongs 720 and 730 are shaped such that while in the closed position, portions 725 and 735 may still be free to move vertically along the length of the media cord 740, however horizontal movement is restricted to the areas of the enclosures underneath the prongs.

Figure 7D:
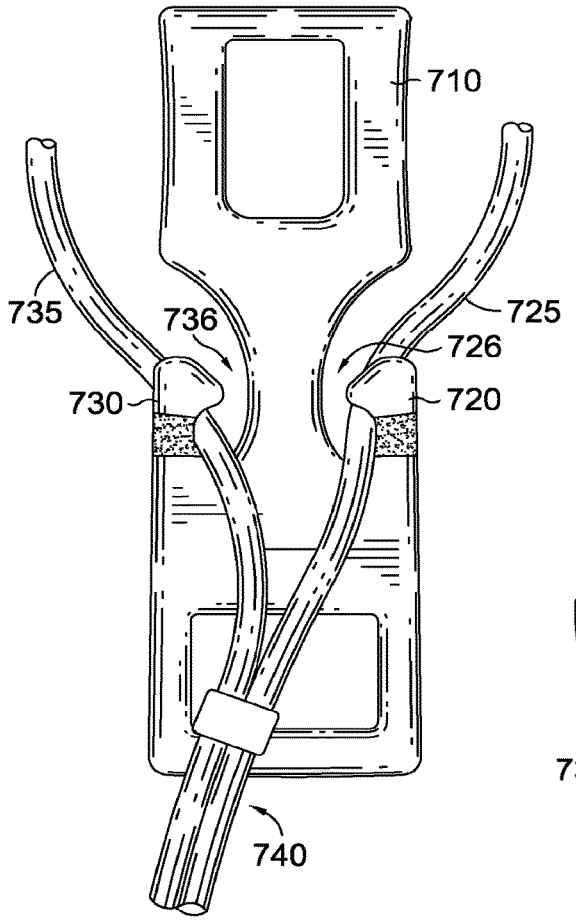
Figure 7E:
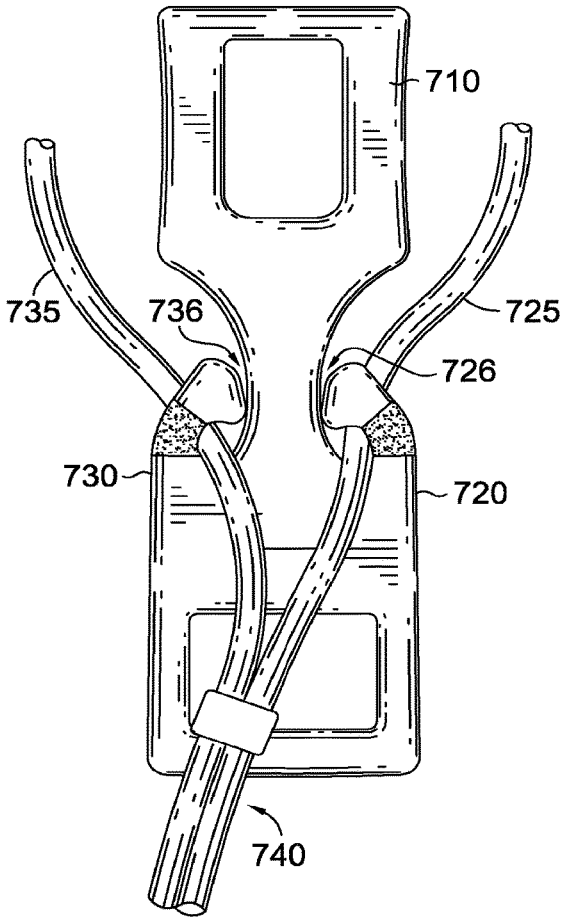

Alternatively, prongs 720 and 730 may be made out of a bendable material such as encased wire or a malleable material such as regrind rubber constructed from recycled or reclaimed rubber mixtures. Bendable or malleable prongs allow the user to freeze the prongs in a position of his/her choosing. For instance, turning briefly to FIGS. 7D and 7E, prongs 720 and 730 are made out of a malleable material and are capable of being fashioned into a shape or bent in a direction of the user's choosing. FIG. 7D shows prongs 720 and 730 in the open position. FIG. 7E shows prongs 720 and 730 in the closed position after being manipulated by the user. In the closed position, prongs 720 and 730 close off gaps 726 and 736, respectively, such that portions 725 and 735 are retained within their respective enclosures.

Now turning to FIGS. 8A and 8B, schematic diagrams showing an example of a cord managing zipper system incorporated into an article of clothing in accordance with the present invention are shown. FIG. 8A shows the cord managing zipper system 820 and two rows of zipper teeth 870 in the engaged position. The cord managing zipper system 820 is incorporated into a sweatshirt 810. In other examples, cord managing zipper system 820 is incorporated into jackets, coats, raincoats, hoodies, vests, sweaters, dresses, and other types of clothing. Media cord 830 is attached to earphones 840 on one end and a music player 850 on another end. Music player 850 is inside pocket 860 which can be located anywhere on jacket 810. Pocket 860 can also be a breast pocket, a pocket attached to an armband, or a pocket on the inside of the jacket. Music player 850 can be further secured inside pocket 860 by the addition of a flap over the pocket which can be closed via a button, a zipper, Velcro, or another contraption. Portions of media cord 830 can be retained in place by either the prongs or cavity on cord managing zipper system 820. FIG. 8B shows the cord managing zipper system 820 and two rows of zipper teeth 870 in the disengaged position. However, portions of media cord 830 are still retained in place by either the prongs or cavity on cord managing zipper system 820.

Figure 9:
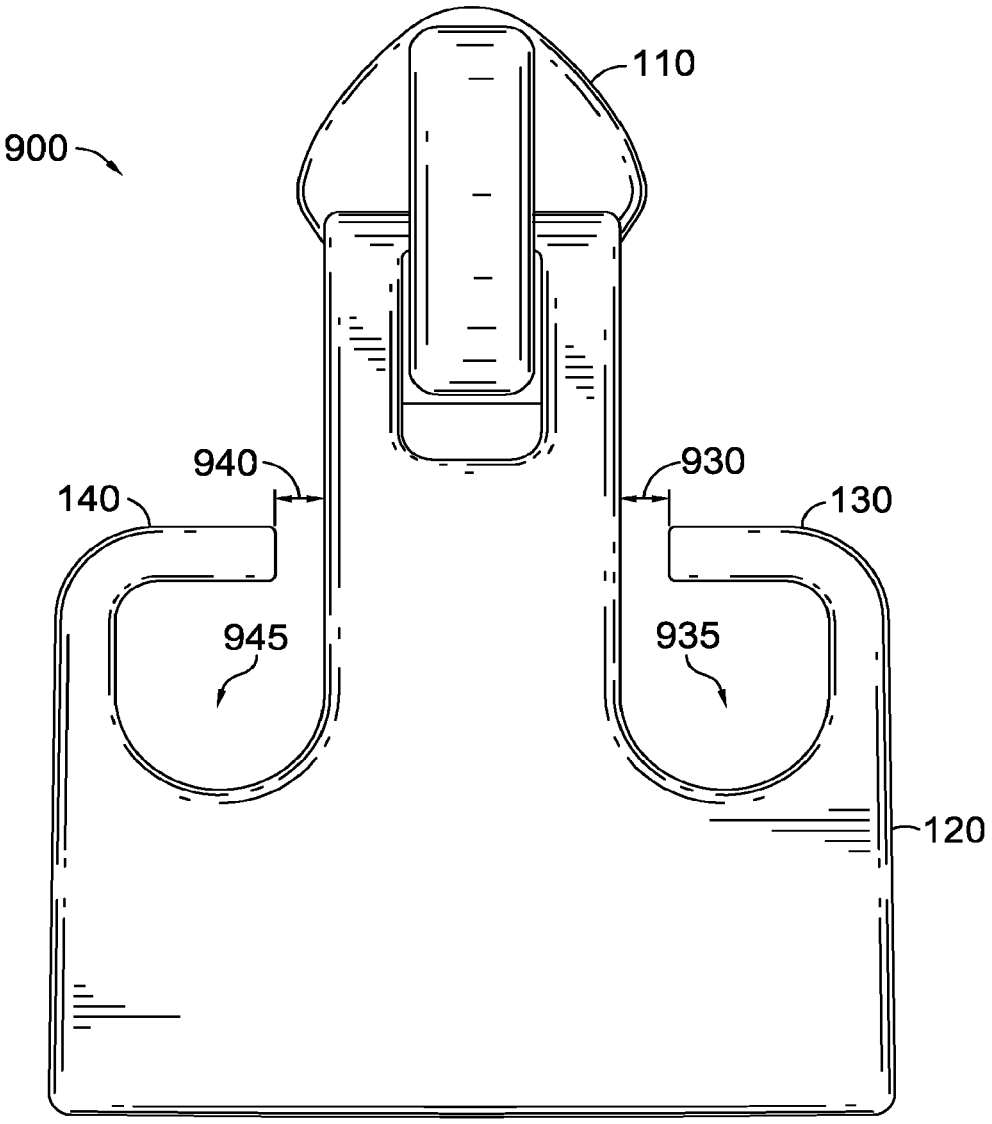

Now turning to FIGS. 9-12, schematic diagrams are presented of examples of cord managing zipper systems in accordance with the present invention. FIG. 9 depicts a zipper system 900 with a zipper slider 110 hingedly attached to a pull tab 120 having prongs 140 and 130 on opposing sides. Prongs 130 and 140 may be circular in shape thereby creating circular spaces 935 and 945, respectively, wherein cords can be retained. The tip of prong 130 may be separated from the lateral side of pull tab 120 by gap 930. Similarly, the tip of prong 140 may be separated from the lateral side of pull tab 120 by gap 940. Gaps 930 and 940 may function to admit cords into spaces 935 and 945, respectively.

Figure 10:
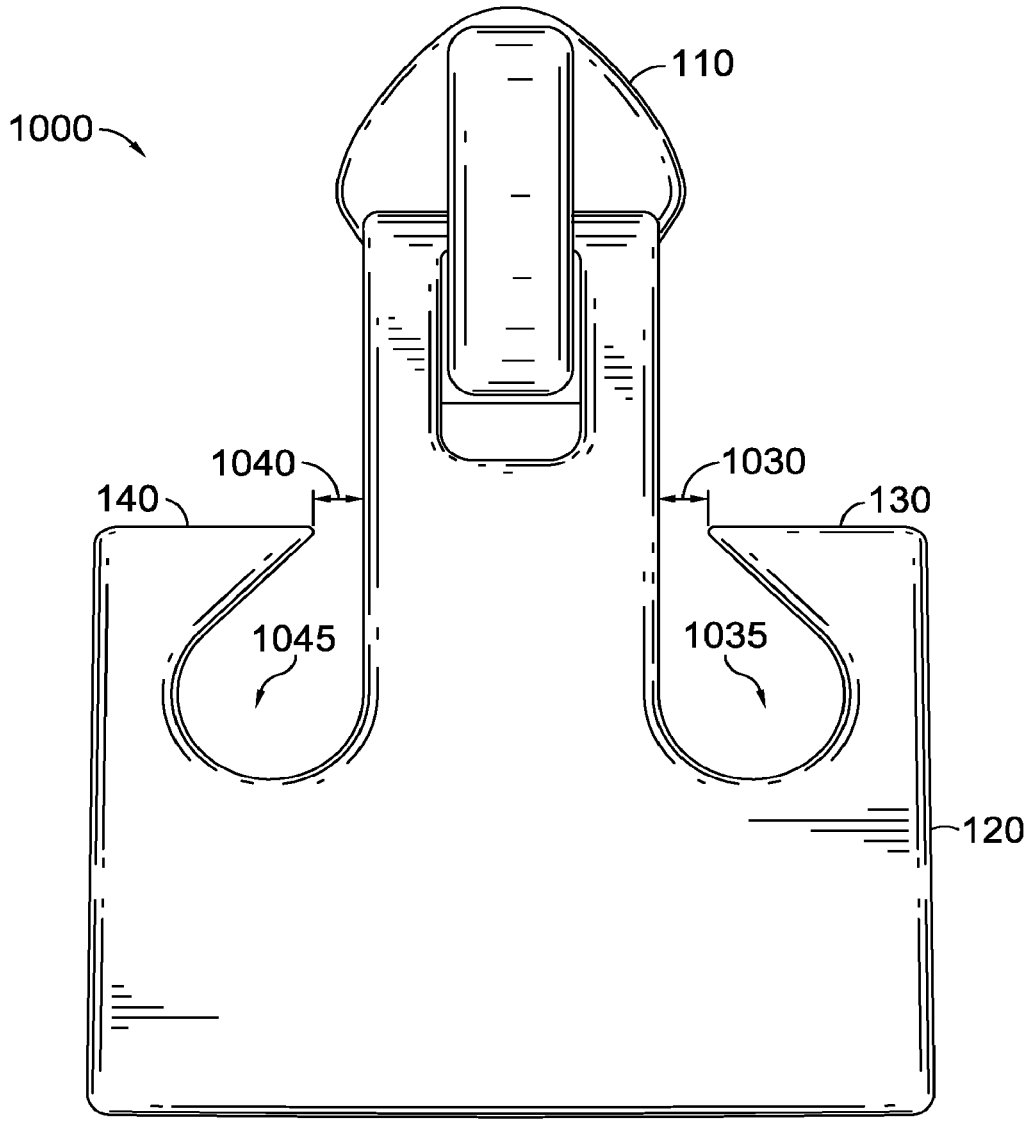

FIG. 10 depicts a zipper system 1000 with a zipper slider 110 hingedly attached to a pull tab 120 having prongs 140 and 130 on opposing sides. Prong 130 may have a profile that is defined by two straight edges on the outside and a curved edge on the inside. Prong 140 can be the mirror image of prong 130's profile. The curved inner edges of the prongs may form two slanted oblong spaces 1035 and 1045 wherein cords can be retained. The tip of prong 130 may be separated from the lateral side of pull tab 120 by gap 1030. Similarly, the tip of prong 140 may be separated from the lateral side of pull tab 120 by gap 1040. Gaps 1030 and 1040 may function to admit cords into spaces 1035 and 1045, respectively.

Figure 11:
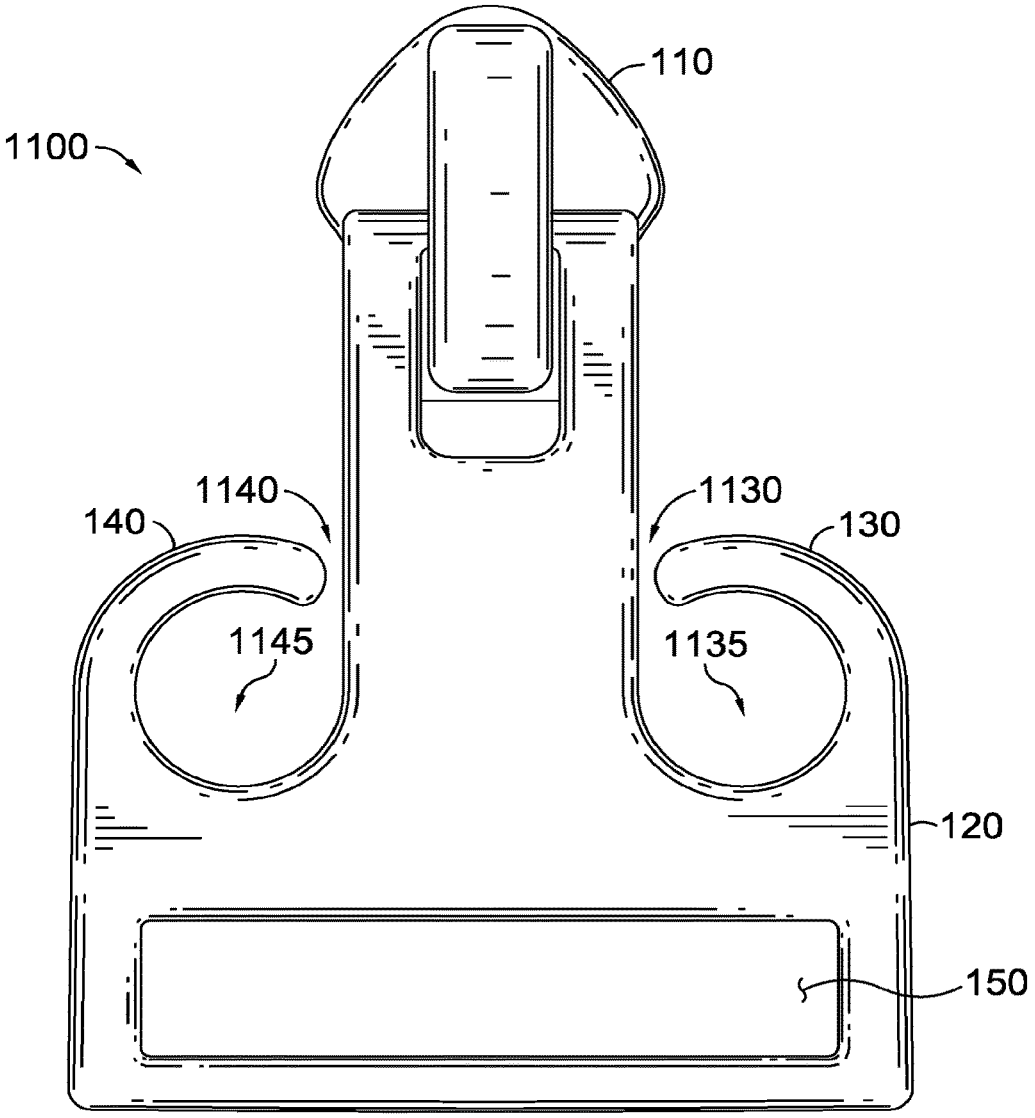

FIG. 11 depicts a zipper system 1100 with a zipper slider 110 hingedly attached to a pull tab 120 having prongs 140 and 130 on opposing sides. In addition, pull tab 120 contains a cavity 150. Prongs 130 and 140 may be circular in shape thereby creating circular spaces 1135 and 1145, respectively, wherein cords can be retained. The tip of prong 130 may be separated from the lateral side of pull tab 120 by gap 1130. Similarly, the tip of prong 140 may be separated from the lateral side of pull tab 120 by gap 1140. Gaps 1130 and 1140 may function to admit cords into spaces 1135 and 1145, respectively. If the width of a cord is greater than the distance of the gaps 1130 or 1140, then the cord or prongs may be encased in compressible material such that the cord can be squeezed through. Cords may also be threaded through and retained by cavity 150.

Figure 12:
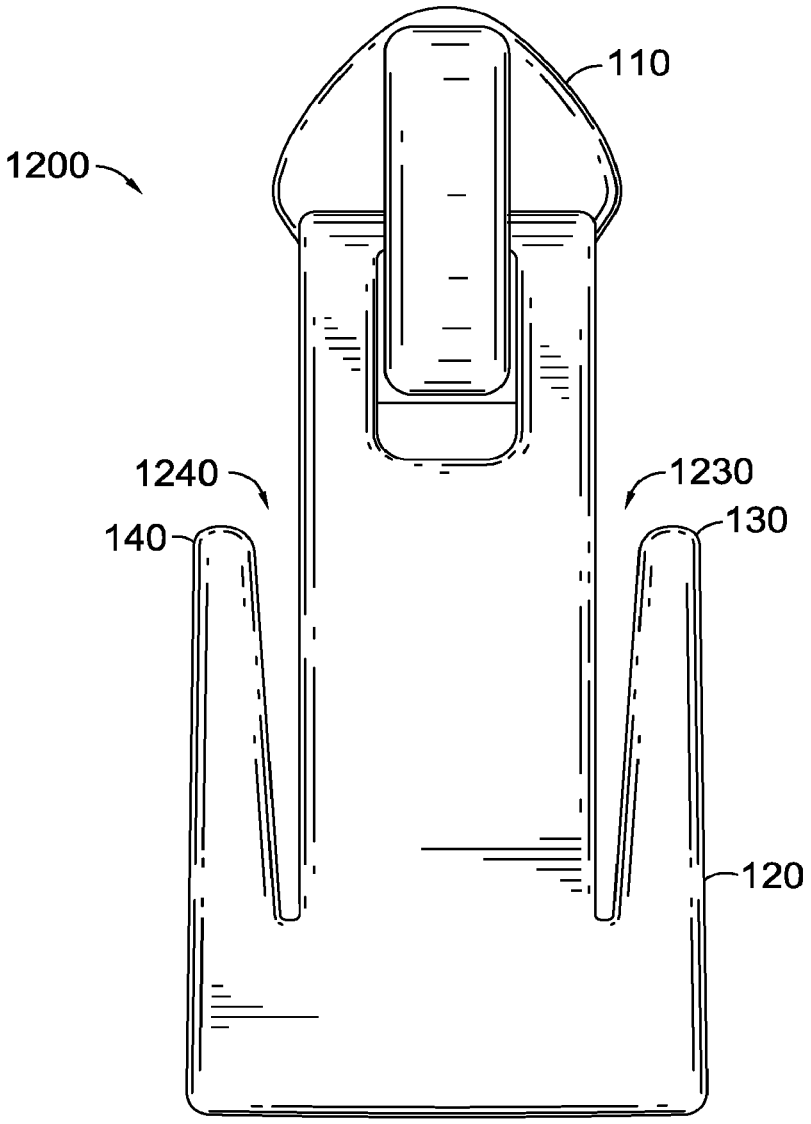

FIG. 12 depicts a zipper system 1200 with a zipper slider 110 hingedly attached to a pull tab 120 having prongs 140 and 130 on opposing sides. Prongs 130 and 140 may be parallel to the lateral sides of pull tab 120 thereby creating two grooves 1230 and 1240, respectively. The grooves 1230 and 1240 are narrow such that a cord may be retained therein by friction between the prongs and the cord alone.

Figure 13:
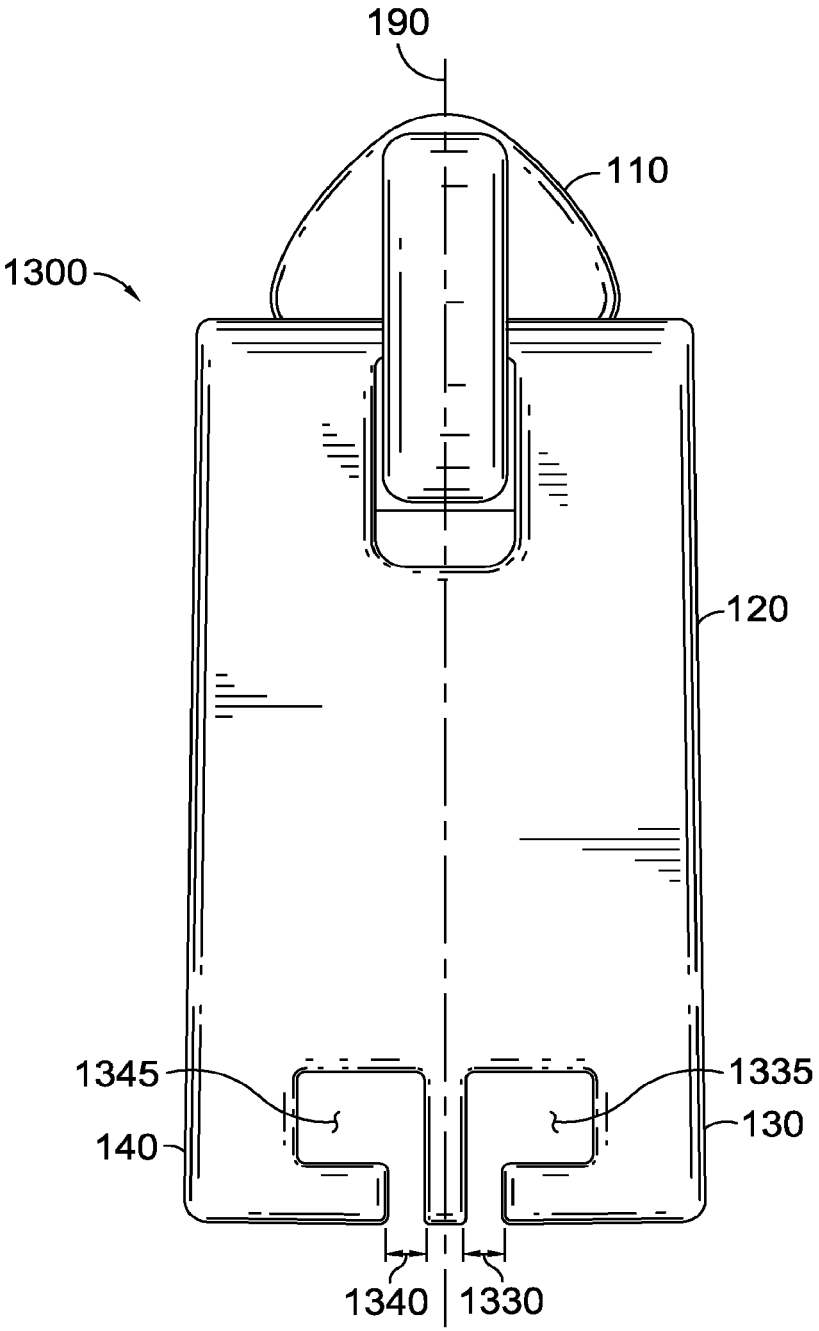

FIG. 13 depicts a zipper system 1300 with a zipper slider 110 hingedly attached to a pull tab 120 having prongs 140 and 130 on opposing sides. Unlike the prongs in FIGS. 9-12, prongs 130 and 140 are oriented downward and face inward with respect to longitudinal axis 190. A cord may be admitted through gap 1330 or gap 1340 and be retained inside enclosed spaces 1335 or 1345, respectively. Gap 1330 or 1340 is narrow enough such that gravity does not cause the cord to exit enclosed space 1335 or 1345, respectively.

Examples of the present invention have been described with the intent to be illustrative rather than restrictive. Alternative examples will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims.

What is claimed is:

1. A zipper system for managing a media cord, the zipper system comprising:

a zipper slider that engages parallel attachment structures that may be in an engaged state to close a garment or in a disengaged state to open the garment, the zipper slider having a front and a back; and a pull tab hingedly attached to the zipper slider, the pull tab comprising:

a front surface and an opposing back surface defining a thickness therebetween;

a longitudinal axis defining a left side and an opposing right side of the pull tab;

a left prong extending from the left side of the pull tab, the left prong having a proximal end and a distal end; and a right prong extending from the right side of the pull tab, the right prong having a proximal end and a distal end, wherein each of the left prong and the right prong further comprise a moveable portion operable to move the left prong and the right prong between an open position for receiving a media cord and a closed position for retaining the media cord, wherein the left prong and the right prong are made from a rigid material, and wherein the movable portion is made from a malleable material.

2. The zipper system of claim 1, wherein the moveable portion is positioned between the proximal end and the distal end of the left prong and the right prong.

3. The zipper system of claim 1, wherein the malleable material is encased wire or regrind rubber.

4. The zipper system of claim 1, wherein the rigid material is a metal or plastic material.

5. A zipper system for managing a media cord, the zipper system comprising:

a zipper slider that engages parallel attachment structures that may be in an engaged state to close a garment or in a disengaged state to open the garment, the zipper slider having a front and a back; and a pull tab hingedly attached to the zipper slider, the pull tab comprising:

a front surface and an opposing back surface;

a longitudinal axis defining a left side and an opposing right side of the pull tab;

a left prong having a proximal end and a distal end, the left prong extending from the left side of the pull tab; and a right prong having a proximal end and a distal end, the right prong extending from the right side of the pull tab, wherein the distal end of the left prong and the distal end of the right prong are moveable between an open position for receiving a media cord and a closed position for retaining a media cord; wherein a movable portion of the left prong and a movable portion of the right prong further comprises a through-hole and a pin, such that the moveable portion of the left prong and the right prong forms a hinged connection.

6. The zipper system of claim 5, wherein the moveable portion is positioned between the proximal end and the distal end of the left pull tab and the right pull tab.

7. A zipper system for managing a media cord, the zipper system comprising:

a zipper slider coupled to a pair of parallel attachment structures; and a pull tab coupled to the zipper slider, the pull tab comprising:

a front surface and an opposing back surface;

a longitudinal axis defining a left side and an opposing right side of the pull tab;

a left prong having a proximal end and a distal end, the left prong extending from the left side of the pull tab; and a right prong having a proximal end and a distal end, the right prong extending from the right side of the pull tab, wherein each of the left prong and the right prong further comprise a moveable portion operable to move the left prong and the right prong between an open position for receiving a media cord and a closed position for retaining the media cord, wherein the left prong and the right prong are made from a rigid material, and wherein the movable portion is made from a malleable material.

8. The zipper system of claim 7, wherein the moveable portion is positioned between the proximal end and the distal end of the left pull tab and the right pull tab.

9. The zipper system of claim 7, wherein when the left prong and the right prong are in the open position, the distal ends of the left and right prong are spaced apart from the left side and the right side of the pull tab.

10. The zipper system of claim 7, wherein when the left prong and the right prong are in the closed position, the distal ends of the left and right prong are in contact with the left side and the right side of the pull tab.

11. The zipper system of claim 7, wherein the zipper system provides access to a jacket, coat, raincoat, hoodie, vest, or sweater.

12. The zipper system of claim 7, wherein the zipper system provides access to a pocket of an article of apparel.

* * * * *